United States Patent [19]

Gutel et al.

[11] Patent Number: 5,044,934

[45] Date of Patent: Sep. 3, 1991

[54] WARM UP BURNER FOR THE HEARTH OF A CIRCULATING FLUIDIZED BED BOILER

[75] Inventors: Jacques Gutel, Montrouge; Christian Duez, Voisins Les Bretonneux, both of France

[73] Assignee: Stein Industrie, France

[21] Appl. No.: 549,989

[22] Filed: Jul. 9, 1990

[30] Foreign Application Priority Data

Jul. 7, 1989 [FR] France ..... 89 09187

[51] Int. Cl.[5] ..... F23D 11/36

[52] U.S. Cl. ..... 431/153; 431/186; 431/189; 110/182.5

[58] Field of Search ..... 431/153, 154, 155, 186, 431/189; 110/195, 263, 182.5

[56] References Cited

U.S. PATENT DOCUMENTS 3,209,810 10/1965 Schuvart ..... 431/154

4,846,080 7/1989 Ross et al. ..... 110/182.5

*Primary Examiner*—James C. Yeung

*Attorney, Agent, or Firm*—Sughrue, Mion, Zinn, Macpeak & Seas

[57] ABSTRACT

An oil-burning or gas-burning warm up burner for the hearth of a circulating fluidized bed boiler. The burner has a fuel lance on the axis of the burner, a rectangular peripheral admission channel admits combustion air around the lance. Air flow channelling sheets are on either side of the lance. The fuel lance is retracted during periods of normal operation of the circulating fluidized bed boiler when the warm up burner is not in operation. The lance is isolated in retracted position from the atmosphere of the hearth. The lance is isolated by longitudinal segments of the combustion air flow channelling sheets constituting flaps provided with an axle perpendicular to the axis of the burner. Rotation of the axles enable the segments to take up positions perpendicular to the burner axis closing the corresponding passage of the combustion air admission channel beyond the end of the lance, when the lance is in its retracted position.

2 Claims, 1 Drawing Sheet

WARM UP BURNER FOR THE HEARTH OF A CIRCULATING FLUIDIZED BED BOILER

The present invention relates to an oil-burning or eas-burning warm up burner for the hearth of a circulating fluidized bed boiler, the burner comprising a fuel lance on its axis, a rectangular peripheral admission channel for admitting combustion air around the lance, air flow channeling sheets on either side of the lance, means for retracting the fuel lance during periods of normal operation of the circulating fluidized bed boiler when the warm up burner is not in operation, and means for isolating the lance in its retracted position from the atmosphere of the hearth.

BACKGROUND OF THE INVENTION

The hearth of such a boiler is equipped to enable it to be warmed up by an oil burner or a gas burner designed to raise the refractory coating and the fluidized bed charge to normal operating temperature. During normal operation, such a burner is stopped and it is then desirable to protect it from the heat radiation and the erosion caused by the charge of solids in the hearth, which charge contains abrasive grains.

Such protection has already been provided by withdrawing the fuel lance through the burner charging hole and by injecting a considerable grain-sweeping air flow through said charging hole in order to prevent solid grains from the hearth penetrating. However the sweeping air flow is too large and this reduces the efficiency of the installation.

Fuel lances have also been withdrawn and isolated from a hearth by closing the flap valve of a peripheral tube (GB-A-956,885) or by closing a trap door disposed in the burner charging hole U.S. Pat. No. 4,781,576. However, such a trap door is bulky, is not completely airtight, and is subject to thermal expansion that may cause it to jam.

The object of the present invention is to provide a warm up burner which is protected from hearth radiation and from erosion by the particles of the fluidized bed, without requiring the injection of a flow of air that would disturb combustion conditions, while using members that are compact, simple in operation, and undisturbed by thermal expansion.

SUMMARY OF THE INVENTION

In the warm up burner of the invention the means for isolating the lance are constituted by longitudinal segments of the combustion air flow channeling sheets constituting flaps, each flap being provided with an axis perpendicular to the axis of the burner and enabling the flap segment to take up a position perpendicular to the burner axis closing the corresponding passage of the combustion air admission channel beyond the end of the lance when the lance is in its retracted position.

BRIEF DESCRIPTION OF THE DRAWING

An embodiment of the invention is described by way of example with reference to the accompanying drawing, in which.

DETAILED DESCRIPTION

Figure 1:
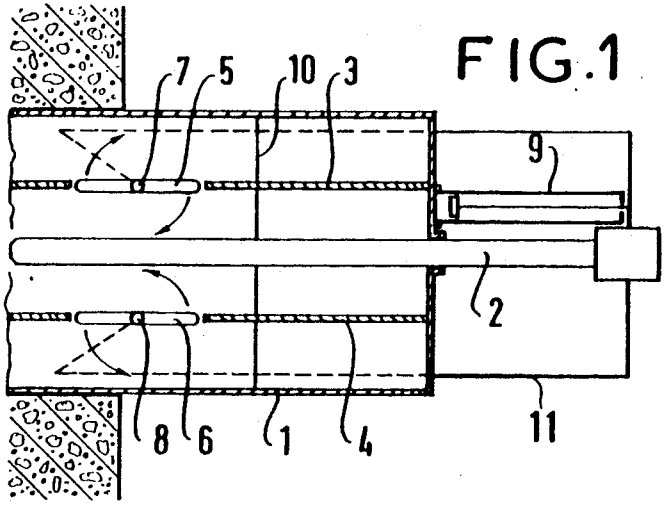
FIG. 1 is a section on a longitudinal plane of symmetry through the lance and the combustion air flow channeling sheets together with their rotary segments in the open position as during a period of operation.
Figure 2:
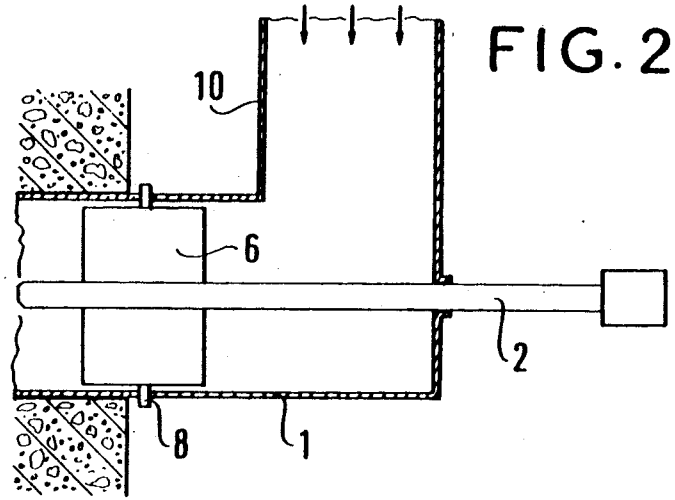
FIG. 2 shows the lance and one of the combustion air flow channeling sheets in section on a plane perpendicular to that of FIG. 1 and disposed between the lance and one of the channeling sheets.

In FIG. 1, the warm up burner disposed in a charging hole 1 of rectangular cross-section comprises an oil or gas injection lance 2 connected to an actuator 9 for advancing or retracting the lance. On either side of the lance there are combustion air flow channeling sheets 3 and 4 for directing air which arrives laterally via a duct 10 (FIG. 2). These sheets have rectangular flaps 5 and 6 disposed therein, with the flaps being capable of pivoting about axles 7 and 8 as shown by arrows in FIG. 1.

These flaps are shown in the retracted position in FIGS. 1 and 2, i.e. the position allowing combustion air to flow.

Figure 3:
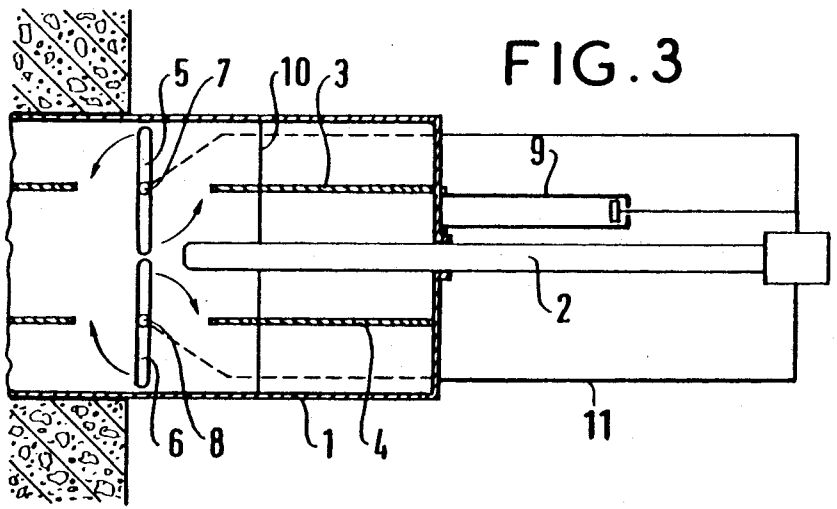
FIG. 3 is a section of the same plane as FIG. 1, showing the lance retracted and the air flow channeling sheet segments in the closed position, during a rest period for the warm up burner, thereby protecting the lance.

FIG. 3 shows the warm up burner in its rest position, with the lance 2 moved to its retracted position by the actuator 9. In addition, the flaps 5 and 6 have been rotated through 90° under drive from a linkage 11, thereby closing the charging hole 1 and the combustion air inlet is closed or reduced to a very low flow rate. The lance 2 is thus protected from hearth radiation and from erosion by particles in the fluidized bed.

The warm up burner is fitted with an ignition system and with a fire detection system.

The position of the various moving parts is controlled by suitable systems (proximity detector or end-of-stroke detector).

A system external to the burner serves to adjust the combustion air flow rates in the outer and in the central channels of the burner independently.

What is claimed:

1. An oil-burning or gas-burning warm up burner for a hearth of a circulating fluidized bed boiler, said burner having an axis and comprising: a fuel lance on said axis, a rectangular peripheral admission channel for admitting combustion air around the lance, a pair of parallel, combustion air flow channeling sheets within said channel, on respective sides of the lance, means for retracting the fuel lance axially outwardly of said channel during periods of normal operation of the circulating fluidizing bed boiler when the warm up burner is not in operation, and means for isolating the lance in its retracted position from the atmosphere of the hearth, said means for isolating the lance being constituted by flaps forming longitudinal segments of said combustion air flow channeling sheets, and in line therewith, an axle connected to the center of each flap perpendicular to the axis of the burner and mounting said flaps to said channel for pivoting from said in line position to a position perpendicular to the burner axis, such that said flaps close the corresponding passage of the combustion air admission channel beyond the end of the lance, when the lance is in its retracted position.

2. A burner according to claim 1, further comprising an actuator and a linkage connecting said actuator to the segments such that the longitudinal segments of the combustion air flow channeling sheets are rotated by said actuator between said in line position and said position perpendicular to said channel axis.

* * * * *